US005252887A

United States Patent [19]

Reisman

[11] Patent Number: 5,252,887

[45] Date of Patent: Oct. 12, 1993

[54] ENVIRONMENTALLY SAFE PINK LAMP

[75] Inventor: Juliana P. Reisman, Lyndhurst, Ohio

[73] Assignee: General Electric Company, Schenectady, N.Y.

[21] Appl. No.: 823,275

[22] Filed: Jan. 21, 1992

[51] Int. Cl.[5] ..... H01J 61/40

[52] U.S. Cl. ..... 313/112; 313/110; 313/116; 359/885; 362/293

[58] Field of Search ..... 313/112, 110, 116, 635; 359/885, 722; 362/293

[56] References Cited

U.S. PATENT DOCUMENTS

| | | | |
|---|---|---|---|
| 3,258,631 | 6/1966 | Elmer | 313/112 |
| 3,327,155 | 6/1967 | Mayer | 313/112 |
| 3,617,794 | 11/1971 | Bakel et al. | 313/112 |
| 4,441,046 | 4/1984 | James | 313/112 |
| 4,441,047 | 4/1984 | Collins et al. | 313/116 |
| 4,597,984 | 7/1986 | Jansma | 427/28 |

*Primary Examiner*—Donald J. Yusko
*Assistant Examiner*—N. D. Patel
*Attorney, Agent, or Firm*—Edward M. Corcoran; Stanley C. Corwin

[57] ABSTRACT

A cadmium and selenium free lamp which emits a pink color when energized and when unlit contains a chrome tin pink sphene pigment.

8 Claims, 1 Drawing Sheet

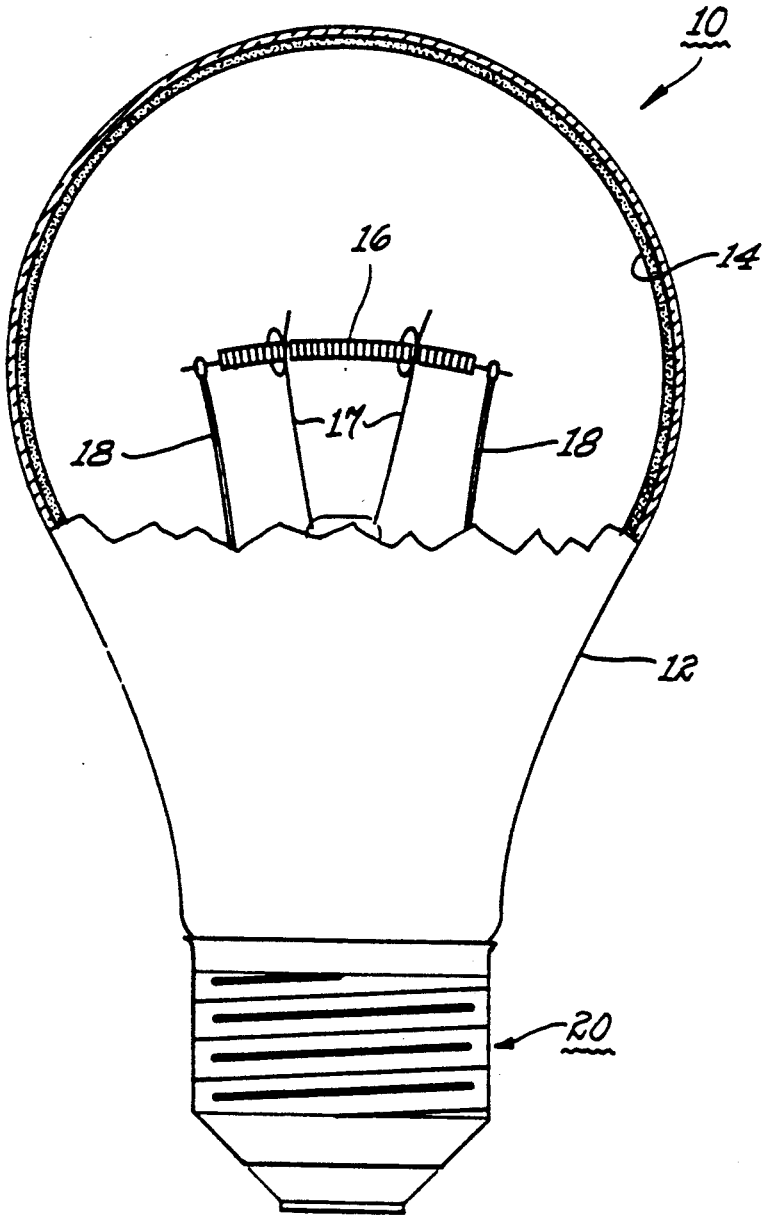
10
16
14
17
18
18
12
20

ENVIRONMENTALLY SAFE PINK LAMP

BACKGROUND OF THE INVENTION

1. Field of the Invention

The present invention relates to an environmentally safe pink lamp which does not contain selenium or cadmium. More particularly, the present invention relates to a pink decorative lamp comprising an electric light source enclosed within a vitreous, light transmissive envelope with a selenium and cadmium free coating comprising a chrome tin pink sphene deposited on the surface of the envelope.

2. Background of the Disclosure

Pink decorative lamps have been made and used for some years and have included pigments such as cadmium selenide and cadmium sulfide in the lamp coating for emitting a pink color. Such lamps generally comprise a glass envelope enclosing a filament within and terminating at one end in a conventional metal screw base, with the interior or exterior surface of the glass envelope containing an inorganic pigment coating which includes cadmium selenide and cadmium sulfide as coating pigments for emitting a pink colored light. Most lamp manufacturers electrostatically apply such coatings as a dry powder to the interior surface of the glass lamp envelope. Electrostatic forces cause the powder to adhere to the interior surface or wall of the glass envelope as disclosed, for example, in U.S. Pat. Nos. 4,441,046; 4,441,047 and 4,597,784, the disclosures of which are incorporated herein by reference. Some decorative lamps have an enamel coating containing such pigments on the exterior surface of the glass envelope. In either case, the coatings must be resistant to the heat generated by operation of the lamp.

Selenium and cadmium containing compounds such as cadmium selenide and cadmium sulfide are regarded as hazardous materials with respect both to workers who are exposed to such materials and also to the environment with respect to disposal of waste containing such compounds. Accordingly, there is a real need to eliminate or at least reduce or minimize the amount of selenium and cadmium present in lamps, including the pink color decorative lamps which employ cadmium and selenium compounds.

SUMMARY OF THE INVENTION

The present invention relates to a lamp which exhibits a pink color when energized and which comprises an electric light source enclosed within a light-transmissive envelope with a coating disposed on said envelope containing a chrome tin pink sphene inorganic pigment and which contains less than 1 wt. % of cadmium and selenium containing compounds. In a preferred embodiment the coating is free of cadmium and selenium containing compounds. In one embodiment, the present invention relates to an incandescent lamp which has a pink color when energized and a glass envelope with a coating containing a chrome tin pink sphene pigment disposed on the surface of the envelope and wherein the amount of cadmium and selenium containing compounds present in said coating is less than 1 wt. %. Preferably the coating is free of cadmium and selenium containing compounds. It has been found that a satisfactory lamp which exhibits a pink color both when energized and in an unlit condition is obtained when the coating contains a mixed metal oxide inorganic pigment comprising oxides of calcium, tin, silicon and chromium and which is classified by the Dry Color Manufacturer's Association (DCMA) as a chrome tin pink sphene.

BRIEF DESCRIPTION OF THE DRAWINGS

The FIGURE schematically illustrates a typical incandescent lamp wherein the inside surface of the glass envelope contains a coating according to the present invention.

DETAILED DESCRIPTION

Turning to the FIGURE, a conventional A-line type of incandescent lamp 10 well known and old to those skilled in the art and to the average consumer is depicted as having a light-transmissive glass envelope 12 enclosing within a filament 16 which is electrically connected to and supported on each end by molybdenum leads 18 which extend through the seal of the lamp (not shown) and attached by means not shown to standard metal screw base 20. Additional support for the filament 16, if necessary, is provided by support wires 17. The interior surface of envelope 12 is coated with a powder coating 14. Powder coating 14 is applied electrostatically by means well known to those skilled in the art. In a conventional white type of incandescent lamp, coating 14 comprises a particulate mixture of alumina and silica or clay particles. The alumina produces the white appearing light (along with a concomitant reduction in light output) and the silica or clay aids as a light scattering component of the coating. In a lamp of the present invention coating 14 will contain a chrome tin pink sphene as the pink light emitting pigment. This pigment produces a pink color when the lamp is in an energized condition and also when the lamp is unlit. The chrome tin pink sphene pigment is an inorganic, mixed metal oxide pigment described by the DCMA as a reaction product of high temperature calcination in which calcium oxide, tin oxide, silicon oxide and chromium oxide are interdiffused to form a crystalline matrix of tin sphene. Its basic chemical formula is designated as $CaO{\cdot}SnO{\cdot}SiO_2{:}Cr_2O_3$ and it is intended primarily for coloring ceramic glazes. Such a pigment suitable for use as the pink pigment of the present invention is commercially available from the Pigments Division (Drakenfeld) of Ciba-Geigy Corporation, Hawthorne, N.Y., and is designated as Drakenfeld 41188A Pink Spersastain with a DCMA number 12-25-5 and a color index number 77301. The average particle size is 5.5 microns. X-ray diffraction and oxygen analysis revealed a sample of this pigment to be 14.4% Ca, 28.6% Sn, 17.6% Si, 0.075% Cr and 39.4% O. An example of a cadmium and selenium free composition of a powder coating useful for coating the interior lamp envelope surface to produce a pink decorative incandescent lamp according to the present invention is set forth below, with the various components expressed in percent by weight of the total powder coating composition:

| THE INVENTION | |
|---|---|
| Pigment | wt. % |
| Drakenfeld 41188A Pink Spersastain | 42.9 |
| Kaolin Clay (Burgess #50) | 38.0 |
| Fumed Hydrophobic Silica (DeGussa R-972) | 14.3 |
| Fumed Hydrophobic Silica (DeGussa OX-50) | 4.8 |
| | 100 |

The kaolin clay and silicas are the light scattering materials. The clay is an aluminosilicate and has an average particle size of 0.46 microns. The R-972 and OX-50 silicas are both fumed silicas and have an average particle size of 16 and 40 nm, respectively. Incandescent lamps of the type illustrated in the FIGURE have been made in 60, 75 and 100 watt sizes employing the above coating electrostatically applied to the interior surface of the lamp envelope and exhibit a pink color in both the unlit and lit condition. These lamps also appear superior to competitive pink decorative lamps (which did not contain the chrome tin pink sphene pigment) in color and coating uniformity.

A typical prior art powder coating for a pink incandescent lamp is set fort below:

PRIOR ART

| Pigment | wt. % |
|---|---|
| Cadmium sulfide (Ciba-Geigy) | 2.4% |
| Cadmium selenide (Ciba-Geigy) | 0.6 |
| Kaolin clay (Burgess #50) | 80.6 |
| Fumed hydrophobic $SiO_2$ (R-972) | 16.4 |
| | 100 |

While the foregoing illustrations have been made with respect to employing standard A-line incandescent lamps for the examples, the invention is not intended to be restricted to such lamps. Thus, it will be understood that the source of light could be an arc instead of a filament such as in a fluorescent lamp or other type of arc lamp. The lamp itself could be a floodlight or spotlight instead of a standard A-line type of lamp, etc. Further, it is understood that a coating containing the pigment employed in this invention can be employed as a powder coating electrostatically applied as set forth above or as an enamel comprising a dispersion of the pigment in a suitable fluid or semi-fluid medium and applied to the inside or outside surface of the lamp envelope. An illustrative, but non-limiting example of the latter is a PAR lamp wherein an enamel is applied to the exterior surface of the lens.

What is claimed is:

1. An electric lamp which exhibits a pink color when energized and which comprises a light transmissive envelope enclosing an electric light source within with a pink coating on the surface of said envelope, said coating containing a chrome tin pink sphene pigment.

2. The lamp of claim 1 wherein said coating contains less than 1 wt. % of compounds which contain cadmium or selenium.

3. The lamp of claim 2 wherein said coating is essentially free of compounds which contain cadmium or selenium.

4. The lamp of claim 3 having a pink color when unlit.

5. An electric lamp which exhibits a pink color when energized and which comprises a vitreous, light transmissive envelope enclosing a filament within and a coating on the surface of said envelope said coating containing a chrome tin pink sphene pigment.

6. The lamp of claim 5 wherein said coating contains less than 1 wt. % of compounds which contain cadmium or selenium.

7. The lamp of claim 6 wherein said coating is free of compounds which contain cadmium or selenium.

8. The lamp of claim 7 exhibiting a pink color in a unlit condition.

* * * * *